United States Patent [19]

Rosenberg

[11] Patent Number: 4,787,102

[45] Date of Patent: Nov. 29, 1988

[54] DETACHABLE PATIENT AID FOR COMMODE

[76] Inventor: Pamela Rosenberg, 33 N. Mercer La., Pearl River, La. 70452

[21] Appl. No.: 19,765

[22] Filed: Feb. 27, 1987

[51] Int. Cl.[4] ..... E03D 11/00

[52] U.S. Cl. ..... 4/254; 4/311; 4/661; 4/DIG. 5

[58] Field of Search ..... 4/254, 301, 307, 311, 4/144.1, 320.3, 661, DIG. 5, 571, 573

[56] References Cited

U.S. PATENT DOCUMENTS

| | | | |
|---|---|---|---|
| 3,412,408 | 11/1968 | Michal, Jr. | 4/301 |
| 3,448,467 | 6/1969 | Smith | 4/307 |
| 3,921,236 | 11/1975 | Klein | 4/254 |
| 3,969,778 | 7/1976 | Richards | 4/254 |
| 4,214,323 | 7/1980 | Thomas | 4/237 |
| 4,587,678 | 5/1986 | Love et al. | 4/254 |
| 4,612,676 | 9/1986 | Whitman | 4/301 |

*Primary Examiner*—Henry J. Recla

*Assistant Examiner*—Linda J. Sholl

*Attorney, Agent, or Firm*—Pravel, Gambrell, Hewitt, Kimball & Krieger

[57] ABSTRACT

An apparatus for assisting an individual, in particular a male with various handicapping conditions, use a commode while standing in the upright position. The apparatus would generally comprise a base portion which would rest on the bowl of the commode, a pair of inserts at the rear of the base portion for inserting into receiving cups mounted in the commode for securing the base to the commode, and upright frame substantially mounted the forward portion of the base for allowing a user to brace himself while standing before the commode, and a receptacle mounted on the front portion of the base, providing an open ended urine receiving portion and a lower disposal portion leading into the bowl itself, for enabling the user to specifically direct the flow of waste into the bowl without physical manipulation of the genitalia.

7 Claims, 2 Drawing Sheets

DETACHABLE PATIENT AID FOR COMMODE

BACKGROUND OF THE INVENTION

1. Field of the Invention:

The apparatus of the present invention relates to patient aids. More particularly, the present invention relates to a detachable brace positionable on a commode for allowing an individual who needs assistance in using a commode while bracing himself in the standing position.

2. General Background:

It is recognized in the medical community that certain males due to handicapping conditions or disabilities often times require assistance to urinate in a commode while in a standing position. The standing position is preferred to insure better drainage of the bladder thereby decreasing potential for infection due to urine retention. Also, more complete drainage lessens frequency and/or amount of leakage of urine toileting sessions. Oftentimes, because a patient is unable to balance himself properly before the commode, or does not have an adequate brace to secure himself while using the commode in the standing position, he may have a difficult time in assuring that the waste product is deposited into the bowl itself.

One particular problem is in the area of children, which due to a specific handicapping condition or disability, such as, but not limited to Cerebral Palsey, Muscular Dystrophy, Blindness, Mental Retardation, are unable to properly utilize the commode in the standing position, and for a child this presents a particular problem since it would require a parent, or other individual, to assist the child in urinating at the commode properly.

Another identifiable problem is that the use of an assist apparatus which may be positioned onto a commode is oftentimes very difficult to place into position properly or to remove from the commode after use, again especially for children.

Certain patents have been found in the art, more particularly, U.S. Pat. No. 4,587,678 to Love, et al, U.S. Pat. No. 4,534,072, to Lipske, U.S. Pat. No. 4,282,611, to Oday, U.S. Pat. No. 4,214,323, to Thomas, and U.S. Pat. No. 4,041,553, to Susman, all in effect show devices which are positioned on or about a commode providing a frame work for assisting a user to more properly use the commode. However, all of them require some manipulative abilities in order to situate the device on the commode, or to remove the device after the device has been utilized for subsequent users of the commode.

Therefore, it would be beneficial that a device be available for individuals who are unable to physically manipulate a device to a commode by attaching through the use of screws or the like, and could simply insert the device into adapters on the commode and remove it in the same fashion.

SUMMARY OF THE PRESENT INVENTION

The apparatus of the present invention solves the problems in the art in a simple and straightforward manner. What is provided is an apparatus for assisting an individual, in particular a male, for use with a commode while standing in the upright position. The apparatus would generally comprise a base portion which would rest on the bowl of the commode, a pair of inserts at the rear of the base portion for inserting into receiving cups mounted on the commode for securing the base onto the commode, a upright frame substantially on the forward portion of the base for allowing a user to brace himself while standing before the commode, and a receptacle mounted on the front portion of the base, for providing an open-ended urine receiving portion and a lower disposal portion leading into the bowl itself, for enabling the user to specifically direct the flow of waste into the bowl without physical manipulation of the genitalia.

Therefore, it is a principal object of the present invention to provide an apparatus to assist a male user of a commode to properly support himself in a safe and secure manner during use of the commode while in the standing position;

It is still a further principal object of the present invention to provide an apparatus for directing the stream of waste from a male user into the bowl of the commode while supported before the commode in the upright position;

It is still a further principal object of the present invention to provide an apparatus which is lightweight and easily attachable and detachable from a commode so that a caretaker may easily position the apparatus onto the commode prior to use and to easily remove the apparatus from the commode following use of the apparatus, and in order for others to use the commode in the usual way;

It is still a further object of the present invention to provide an apparatus which will assist in orientation of proper positioning in front of the commode for children with blindness, mental retardation or any number of other various handicapping conditions; and It is still a further principal ojbect of the present invention to provide a means by which a male child with any number of handicapping conditions may urinate in a standing position promoting normalization, increased self-esteem, and social acceptance.

DETAILED DESCRIPTION OF THE PREFERRED EMBODIMENT

Figure 1:
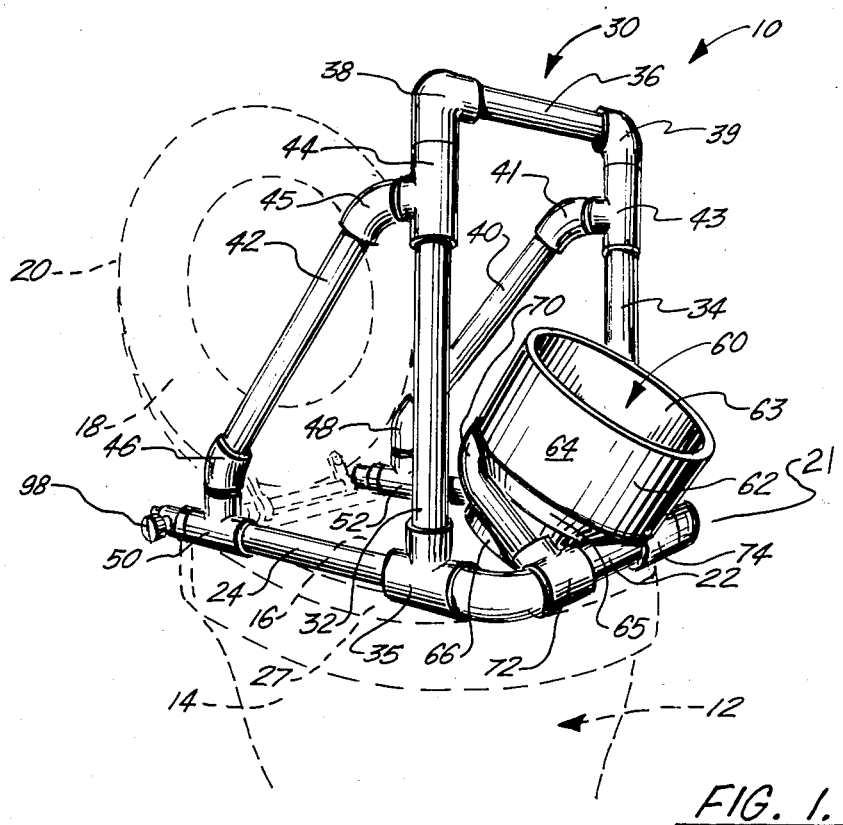
FIG. 1 is an overall perspective view of the preferred embodiment of the apparatus of the present invention mounted on a commode.

FIGS. 1–4 illustrate the preferred embodiment of the apparatus of the present invention illustrated by the numeral 10. Apparatus 10 as seen particularly in FIG. 1 would be mounted on a commode 12 of the type having a lower toilet bowl 14, toilet bowl 14 having an upper opening 16 so that a user may deposit waste thereinto, the commode 12 being mounted on the floor or the like. Commode 12 would further include a hinged seating member 18 hingedly attached to the rear of the bowl as in a conventional type for moving between the up and down positions, and a cover 20, likewise hinged to the rear of the bowl, for covering the commode when not in use.

Turning now to apparatus 10 of the present invention, apparatus 10 would substantially comprise a U-shaped base portion 21 having a pair of side base members 24 and 26 connectably engaged to transverse portion 22 to shape generally a U-shaped base member which is of substantial width to be positionable on the rim 27 (top--surface of toilet bowl 14). As seen in the FIGURES, base 21 would have attached thereto along substantially the front portions of members 24 and 26, a vertically depending brace means 30. This brace means 30 would further include a pair of vertical side members 32 and 34 each member 32 and 34 rigidly attached along the front portion of members 24 and 26 respectively via T joint members 35. Brace means 30 would further include a horizontal interconnecting transverse member 36 which would be rigidly connected to upright members 32 and 34 via elbow joints 38 and 39, the members 32, 34 and 36 defining a vertical brace means 30 so that a user may support himself with his hands substantially gripping or leaning against member 36 during use of the apparatus.

Brace means 30 would be further supported to base 21 via a pair of angular brace members 40 and 42, brace members 40 and 42 extending from an uppermost T joint 43 and 44 mounted on members 32 and 34 respectively, and extending down from 45° angle joints 41 and 45 to angle joints 46 and 48 and attachable to T members 50 and 52 respectively to more securely support brace means 30 in its connection to base member 21. Therefore, what is being provided with this structure is a means for supporting the user of a commode while standing before the commode the combination of the horizontal U shaped base member resting on the commode, with the horizontal support means 30 rigidly attached to the base member 22 and supported further by support means 40 and 42.

Turning now to a structure which is also pertinent to the present invention, there is included a waste receiving means 60 which comprises an upper broad mounth receptacle member 62, open ended on its upper end at 63, and having an annular wall portion 64 the lower portion of which recedes into a tapered annular wall 65 to form a lowermost annular waste deposit portion 66, the receptacle member 60 utilized to receive waste such as urine from a male standing before the commode in the broad open mouth 63 and the waste being deposited into the toilet bowl out of waste deposit means 66, thus assuring any waste being directed into toilet bowl 14 by the user would flow into the bowl as expected.

The receptacle means 60 is mounted onto frame member 22 via a U shaped mounting means 70 which comprises a first end mounted via a T member 72 onto the front portion of base member 21 and a second end mounted likewise via T member 74 on a second portion of the base member 22, the U shaped member 70 defining an opening therewithin for the insertion of receptacle 63 as seen in the FIGURES. Receptacle 63, for purposes of use of the apparatus, is easily insertable and removable from its position as seen in the FIGURES, while the apparatus is or is not in use.

What is further pertinent to the present invention is the means by which the apparatus 10 is mounted on toilet bowl 14. As seen in the FIGURES, there is provided a transverse flat metal bar 80 attached to toilet bowl 14 via mounting bolts 82 and 84 which are the mounting bolts that would mount seat member 18 and cover 20 onto the rear of the commode. Therefore, in operation bolts 82 and 84 would simply be removed from the commode, plate member 80 would be positioned thereupon and bolts 82 and 84 replaced for continued use of the seat 18 and cover 20. Plate 80, as seen particularly in FIGS. 2 and 4, would have on its end portions a pair of angular cup members 86 and 88 respectively, with cup members 86 and 88 serving as a receiving means during mounting of apparatus 10.

Figure 4:
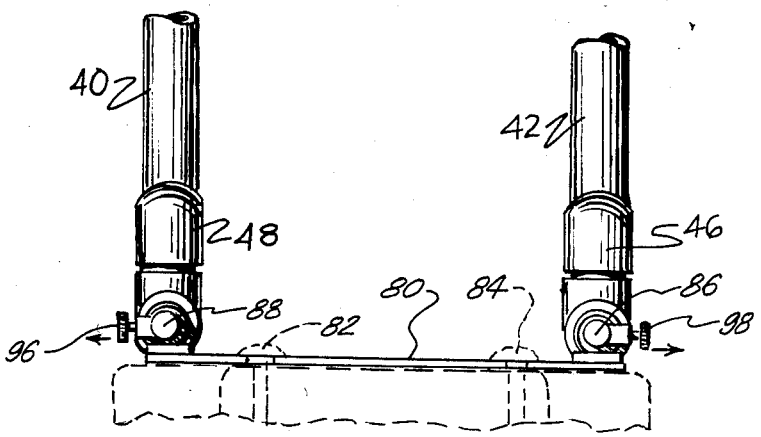
FIG. 4 is a detailed view of the mounting members in the preferred embodiment of the apparatus of the present invention.

As seen in the FIGURES, rearwardly to T frame members 50 and 52 on the rearwardmost portion of the frame 21, there extrudes from the rear therefrom a pair of male members 90 and 92 which are smaller in diameter and tapered and are insertable into receiving means cup members 86 and 88 respectively as seen in FIG. 4. Further, male members 90 and 92 would comprise an indentation in their wall portions so that once inserted into cup members 86 and 88, spring loaded buttons 96 and 98, spring mounted in the wall of members 86 and 88 and retreivable against the bias of the spring, are allowed to project into the indentation in the wall portions of male members 90 and 92. Thus, the frame is "locked" in place on commode 10 as seen in FIG. 1, and ready for use after cup 60 has been inserted thereupon. Following use, a simple retraction of members 96 and 98 against the bias of the spring allows the male members 90 and 92 to slip out of cup members 86 and 88, and the apparatus is removed. Therefore,the only remaining structure which is maintained on the commode at all times is transverse metal bar 80 and cup members 86 and 88 with spring loaded buttons 96 and 98 mounted in their exterior wall. A strap 5 could optionally be used with some patients/users if needed for further stability.

Figure 2:
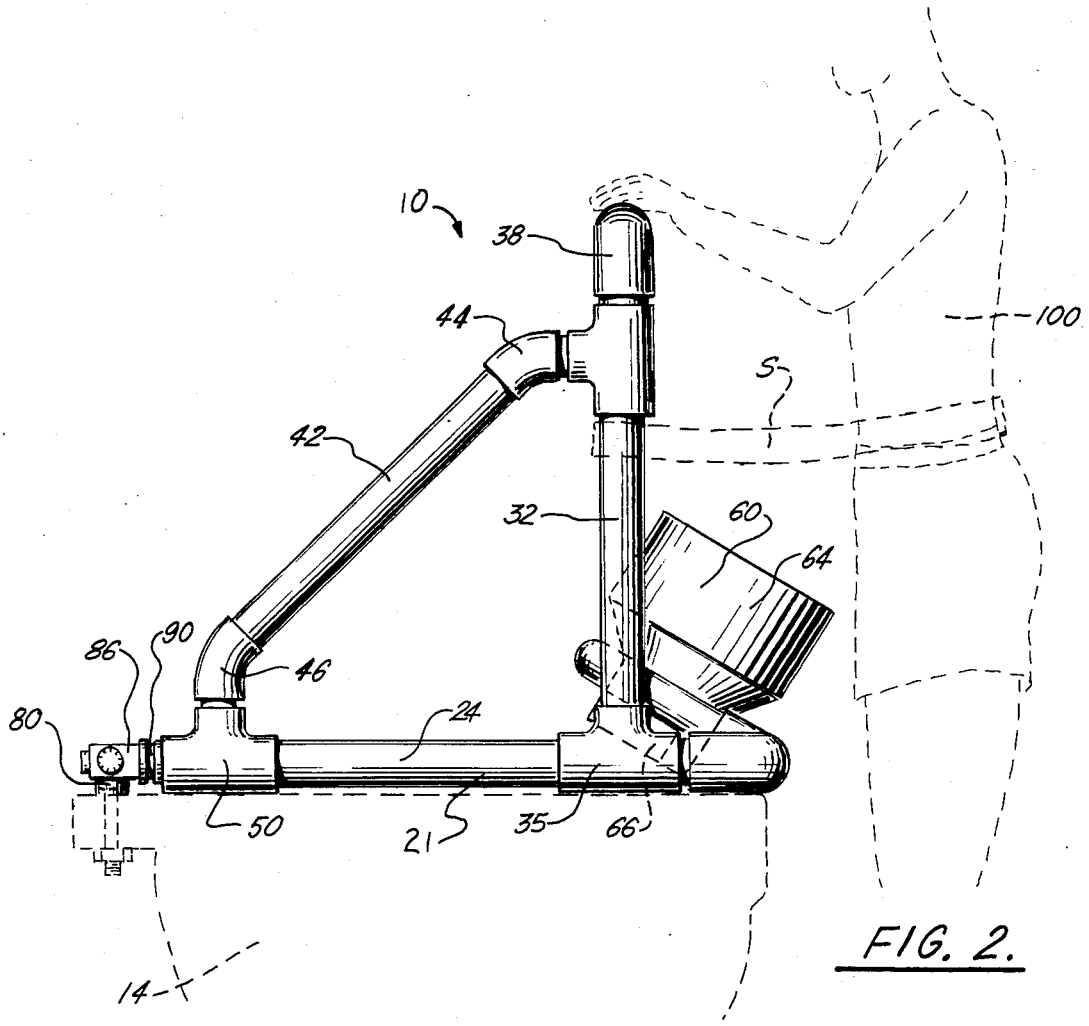
FIG. 2 is a side view of the preferred embodiment of the apparatus of the present invention illustrating a user standing herebefore.
Figure 3:
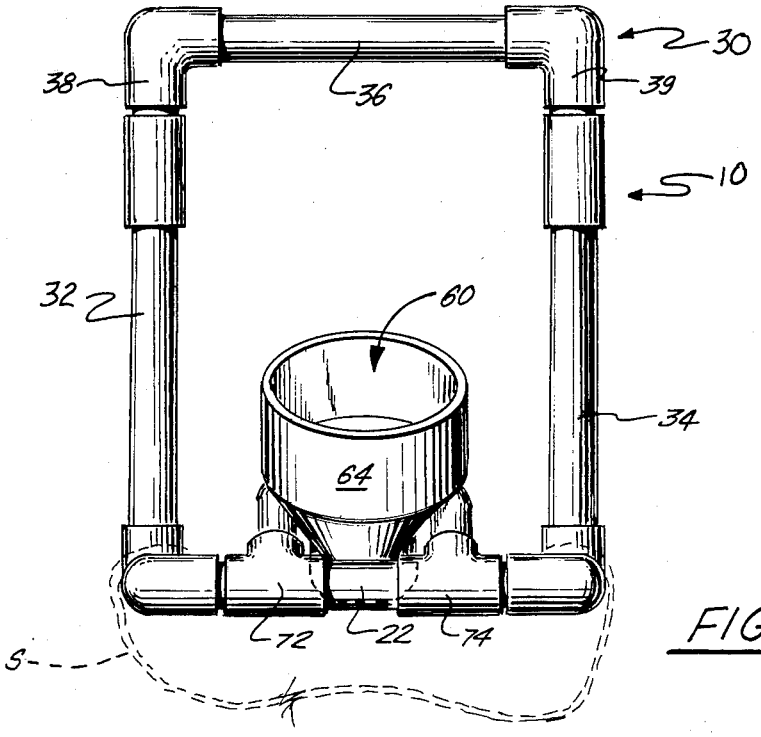
FIG. 3 is a front view of the preferred embodiment of the apparatus of the present invention.

For purposes of construction, apparatus 10, would normally be constructed of a lightweight plastic such as PVC pipe, which could be easily interconnected via the joint members as seen in the FIGURES, and would provide a lightweight yet secure frame insertable onto a commode for use by a person 100 as seen in FIG. 2.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limting sense.

What is claimed as invention is:

1. A urinal apparatus for assisting a male child with a handicapping condition in use of a commode having a rim and an open bowl, comprising:

a. a base portion connectable to the commode, and including a pair of spaced apart horizontal members that are positioned on the rim of the commode, a pair of upright members extending above the commode, and a transverse member defining a handle for a user;

b. connection means positioned rearwardly of the commode bowl for attaching the base portion to the commode at rear end portions of the horizontal members; and c. a receptacle removably mounted on the base portion forwardly of the bowl for providing a flow passage for waste from the user into the commode and for allowing easy cleaning.

2. The apparatus of claim 1, wherein the connection means comprises in part a pair of spaced apart cylindrical receptacles mounted on the commode for receiving the rear end portions of the horizontal members.

3. The apparatus of claim 1, further comprising a pair of diagonally extending supports that project rearwardly of a vertical plane containing upright members.

4. The apparatus of claim 1, further comprising diagonal member extending between an upper end of an upright member and the rear end portion of a horizontal member.

5. The apparatus of claim 1, wherein the connection means comprises a bracket having two ends, a pair of spaced apart cup members mounted at the ends of the bracket, and locking pin means for releasably locking the cups and horizontal members with respect to each other.

6. An apparatus for assisting a person with a handicapping condition or disability in using a commmode while in the standing position, the commode having a rear and comprising a toilet bowl and a rim, the apparatus comprising:

a. a substantially horizontal, U-shaped base portion resting on the rim of the commode, the U-shaped base portion having ends and a front portion;

b. a pair of receptacles securely mounted on the rear of the commode, the receptacles being of a distance apart to enable insertion of the ends of the U-shaped base portion into the receptacles; and c. means removably mounted on the front portion of the U-shaped base portion for providing a receptacle for receiving waste flow from the user and direcrting the flow into the toilet bowl.

7. The apparatus in claim 6, wherein the U-shaped base portion further comprises a pair of said base members, and wherein the apparatus further comprises an upright brace member extending between the side base members of the U-shaped base portion and secured thereto for allowing a person to grasp or lean against the upright brace member and support himself during use of the apparatus.

* * * * *